United States Patent [19]

Miehlich

[11] Patent Number: 4,595,195

[45] Date of Patent: Jun. 17, 1986

[54] APPARATUS FOR PRACTICING SKIING

[76] Inventor: Dieter Miehlich, Gubener Strasse 13½, D-8900 Augsburg, Fed. Rep. of Germany

[21] Appl. No.: 576,191

[22] Filed: Feb. 2, 1984

[30] Foreign Application Priority Data

Feb. 22, 1983 [DE] Fed. Rep. of Germany ..... 3306087

[51] Int. Cl.[4] ..... A63B 69/18

[52] U.S. Cl. ..... 272/97; 434/253

[58] Field of Search ..... 272/97, 70, 96; 434/253

[56] References Cited

U.S. PATENT DOCUMENTS 3,912,260 10/1975 Rice ..... 272/97

FOREIGN PATENT DOCUMENTS 481658 1/1970 Switzerland ..... 272/97

*Primary Examiner*—Richard J. Apley
*Assistant Examiner*—S. R. Crow
*Attorney, Agent, or Firm*—Peter K. Kontler

[57] ABSTRACT

An exercising apparatus for use by skiers to practice downhill runs, slalom runs and analogous types of runs has a main frame supporting a swaying frame which is turnable with reference to the main frame about two parallel horizontal axes extending longitudinally of the main frame. The movements of the swaying frame to either side of a central longitudinal vertical symmetry plane are opposed by strong coil springs whose bias is adjustable by a feed screw. The swaying frame carries a seesaw frame which is rockable with reference thereto about one or more horizontal axes disposed in the central longitudinal symmetry plane of the swaying frame. Two ski boot supporting platforms are mounted on the seesaw frame at the opposite sides of the symmetry plane of the swaying frame, and each such platform is tiltable about a longitudinally extending horizontal axis, turnable about a vertical axis and/or movable lengthwise toward the front or rear end of the swaying frame, always against the opposition of one or more springs which tend to maintain the platform in a neutral position. The seesaw frame enables the user to move one of the platforms downwardly with attendant automatic upward movement of the other platform and vice versa, preferably against the opposition of one or more leaf springs.

20 Claims, 19 Drawing Figures

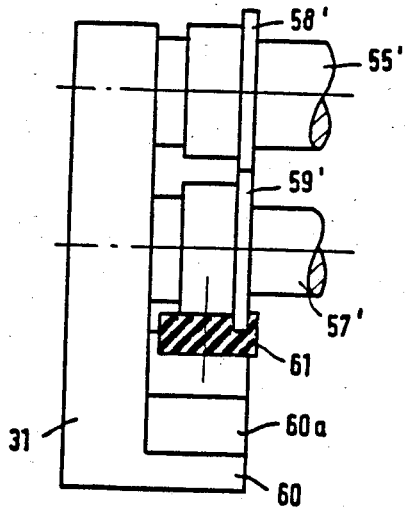
FIG. 8
FIG. 9
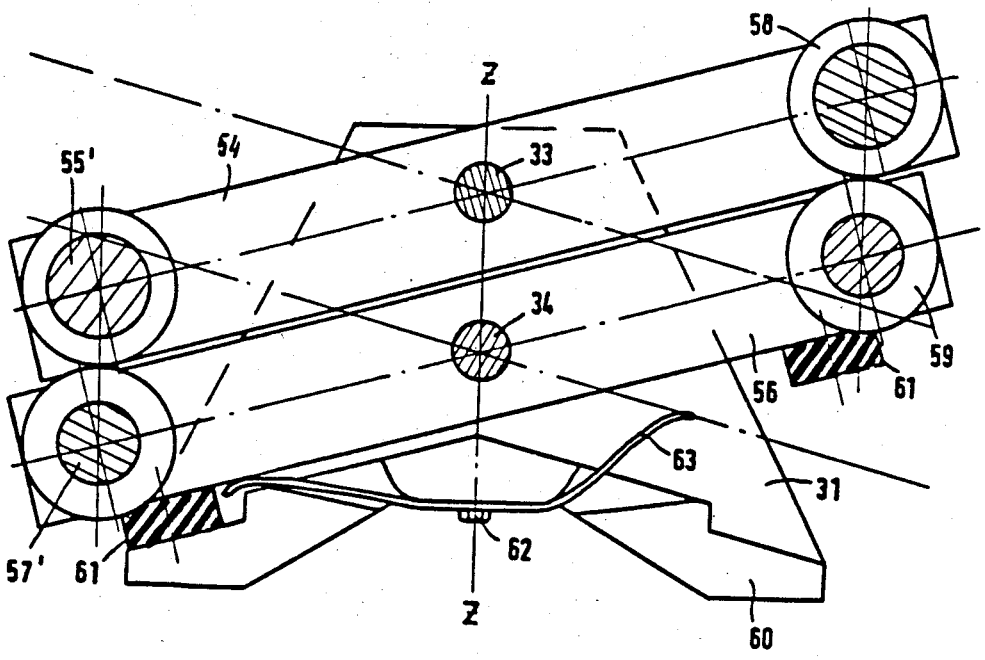

APPARATUS FOR PRACTICING SKIING

BACKGROUND OF THE INVENTION

The present invention relates to exercising apparatus in general, and more particularly to improvements in apparatus which render it possible to carry out exercises in imitation of skiing, especially downhill and slalom runs.

An exercising apparatus which is to be used by a budding or experienced downhill or slalom skier should meet several requirements including enabling the user to carry out (more or less automatically) movements of the type expected from a downhill or slalom skier as well as to strengthen certain muscles which are active during running on snow. As a rule, the movements include (depending on the terrain and style of the skier) the following individual movements:

(1) A more or less pronounced up-and-down movement.

(2) Stressing of the outer ski in a curve with simultaneous lowering of the outer ski.

(3) Inclination of the skis (edge setting) so that their inner edges are in contact with the snow in a turn.

(4) Turning of feet with the toes facing inwardly in the turn.

(5) Longitudinal shifting of feet with the inner ski located ahead of the outer ski in a turn.

The majority of movements involve an up-and-down movement with a lowermost position during the making of a turn with the smallest radius. Alternatively, the skier can also lower his or her body while running straight downhill; this involves running with the upper part of the body relatively motionless but with a pronounced leg action, particularly an activity of muscles in the thighs. The turns are made with pronounced straightening of the knee joints.

An exercising apparatus which is to be used by downhill and/or slalom skiers should be capable of enabling the user to perform the above-enumerated movements as well as to oppose such movements with a requisite force which must be overcome by the user who thereby builds his or her muscles and becomes aware of the conditions under which stressing of certain muscles or groups of muscles takes place.

Heretofore known exercising apparatus are constructed and assembled to facilitate certain types of exercises as well as to enable the user to improve his or her balance and to strengthen certain muscles which are active during skiing. For example, German Offenleguntsschrift No. 19 26 816 discloses an exercising apparatus with pedals which can be caused to move up and down under the action or against the opposition of springs tending to maintain the pedals in a neutral position. In addition, the apparatus of this German printed publication allows for independent movements of pedals against the opposition of resilient means. Nevertheless, the versatility of the apparatus is rather limited because the user cannot move his or her feet forwardly, because the apparatus does not embody any means which would permit each foot to turn about a vertical axis, because the apparatus does not permit the boots to move to positions corresponding to edge setting of the skis, and because the apparatus does not provide any simulated relief for the heels in the raised stage.

German Utility Model No. 82 02 544 discloses a pivotable lever whose free end portion carries a platform for ski boots and is pivotable from a neutral position against the opposition of a strong spring. The inclination of the pivot axis for the lever is adjustable within certain limits and the lever can be pivoted about such axis to both sides of the neutral position. Any such pivoting of the lever involves a very pronounced twisting of feet from the positions they would occupy during a straight downhill run. Moreover, the apparatus of this Utility Model does not permit any forward shifting of the boots and/or edge setting and/or up-and-down movements of the boots. The apparatus merely enables the user to practice a single movement (namely, lowering of the body to thereby reduce the pressure upon the skis) but the apparatus does not allow for any appreciable strengthening of muscles in the thighs of the user.

A modification of the just discussed prior exercising apparatus is disclosed in German Offenlegungsschrift No. 18 06 893. The modified apparatus allows for independent longitudinal movements of two tiltable boot-supporting platforms against the opposition of springs. However, such apparatus does not permit any up-and-down movements of the platform independently of each other and/or any turning of the platforms about vertical axes.

A rather complex and expensive exercising apparatus is disclosed in German Offenlegungsschrift No. 23 58 117. This apparatus allows for lateral movements of platforms for the boots in parallelism with one another in response to appropriate movements of the user's body. The last stages of lateral movements are damped by springs. The platforms are mounted on substantially universal joints which render the mounting of such platforms highly unstable. Moreover, the resistance of platforms to various movements of the legs and feet is minimal so that the apparatus is incapable of building muscles and/or automatically generating forces which must be overcome by a skier in the course of an actual run down a slope. The apparatus of this German printed publication is intended for use by highly skilled skiers but is not suitable for beginners or weekend skiers.

A further exercising apparatus is disclosed in German Pat. No. 22 24 798. This apparatus does not permit for up-and-down movements of the boots and/or for edge setting of the platforms so that its ability to prepare a skier for downhill or slalom skiing is limited, both as regards the practice of required movements as well as concerning the strengthening of some or all of the muscles which are used by the skier in the course of a downhill or slalom run.

An apparatus which also belongs to the category of the aforediscussed exercising apparatus is disclosed in German Offenlegungsschrift No. 25 15 570. The apparatus of this prior publication allows for independent forward movements of the platforms for ski boots as well as for simultaneous movements of both platforms about a common substantially vertical pivot axis which is located in front of and is remote from the platforms. A certain amount of tilting movement of the platforms is also possible. However, neither platform is movable up or down against a pronounced restoring force. In fact, none of the afore-enumerated movements are carried out against the resistance of springs so that the apparatus is incapable of performing any noticeable muscle building action. In addition, and in view of the absence of any means for opposing various movements of the platforms, the apparatus of this German printed publication does not enable the user to acquire the ability to carry out a number of different movements, always from a given neutral position and back to such neutral position. On the contrary, the user must memorize the neutral positions which is not conducive to an exercise that more or less compels the user of the exercising apparatus to acquire the ability to automatically move the boots to neutral positions as shown as the need for edge setting of skis, turning of heels in the bindings, forward or rearward movements of the boots, upward and downward movements of the boots and/or any combination of such movements is terminated.

Still another prior art apparatus for use by skiers or prospective skiers is disclosed in German Offenlegungsschrift No. 15 78 640. The apparatus of this printed publication employs a wheel-mounted conveyance which is designed for travel along a pair of slightly convex rails and has platforms for the boots of the user. There is no provision for springs or other resilient means which could return the conveyance to a neutral position with a pronounced force. Basically, the apparatus of this German printed publication enables the user to perform a small number of movements without any muscle building or other conditioning of the body. The conveyance allows for slight longitudinal movements of the platforms and the platforms are also free to tilt to a certain extent against the opposition of springs. However, the platforms cannot turn about vertical axes and they do not permit the legs to perform the very important up-and-down movements with attendant muscle building action.

It will be seen that the apparatus which are presently used, or proposed to be used, as exercising machines by downhill or slalom skiers are incapable of furnishing a full range of possibilities to develop all muscles which are used in the course of such activities as well as to enable the user to practice each and every movement which must be performed with and/or relative to the skis on a snow-covered slope.

OBJECTS AND SUMMARY OF THE INVENTION

An object of the invention is to provide a universal exercising apparatus which enables the user to perform all such exercises which are important for his or her safety on a snow-covered slope during a downhill run or an analogous run.

Another object of the invention is to provide an exercising apparatus which allows for adequate building of all muscles that must be strengthened for safe and satisfactory skiing in general and for a downhill, slalom or giant slalom run in particular.

A further object of the invention is to provide an apparatus which renders it possible to perform a number of different exercises which closely resemble the movements that are performed on flat or uneven snow-covered terrain.

An additional object of the invention is to provide an exercising apparatus which is especially suitable for strengthening of the muscles in the thighs and buttocks.

Another object of the invention is to provide an apparatus which is relatively simple and compact, wherein each and every movement which is to be performed by the user is or can be opposed by a spring force of optimum magnitude, and which can be used with equal advantage and equal desirable results by novices, weekend skiers or highly advanced amateur or professional skiers.

An additional object of the invention is to provide an apparatus which can be readily adjusted so as to be best suited for use by children, teenagers, male or female skiers, adults, beginners lacking any previous exercise or actual skiing experience, or advanced and professional skiers.

Another object of the invention is to provide an apparatus which can be designed or adjusted to take into consideration the weight of the user.

A further object of the invention is to provide an exercising apparatus which can be used for indoor practicing of all kinds of movements or sequences of movements which come into question during a downhill, slalom, giant slalom or other run and which enables the user to perform such movements in a manner that comes closer to actual movements on a snow-covered terrain than is achievable with heretofore known apparatus.

An additional object of the invention is to provide a novel and improved method of exercising various parts of the human body preparatory to or in lieu of downhill or slalom running.

Another object of the invention is to provide the apparatus with novel and improved means for supporting the platforms for the boots or feet of the user.

A further object of the invention is to provide an apparatus which can be used as a superior substitute for two or more different types of conventional apparatus.

Another object of the invention is to provide an apparatus whose versatility considerably exceeds that of conventional exercising apparatus and which can be used in homes, gyms, ski lodges and other establishments which house or are likely to be frequented by skiers or budding skiers.

Still another object of the invention is to provide an apparatus which is safer than heretofore known apparatus, which is not likely to soil or tear the garments of the users, and which requires a minimum of training for utilization with optimum results.

The invention is embodied in an exercising apparatus which can be used with particular advantage by downhill skiers. The apparatus comprises a stationary main frame and a swaying frame having a first and a second pair of aligned front and rear links each including a lower end portion pivotally mounted in the main frame and an upper end portion. The swaying frame further comprises carrier means which is pivotally secured to the upper end portions of the links for angular movement about parallel substantially horizontal axes (the carrier means can comprise front and rear end walls which are respectively pivoted to the front and rear links, longitudinally extending connecting rods secured to the two end walls and a seesaw frame mounted on the connecting rods). The apparatus further comprises resilient means (e.g., at least one set of strong coil springs) for biasing the swaying frame to a neutral position in which the links are disposed at the opposite sides of a first central longitudinal vertical symmetry plane extending between the lower end portions of the two pairs of links. The links are pivotable with reference to the main frame to either side of the first symmetry plane against the opposition of the resilient means and the swaying frame has a second central longitudinal vertical symmetry plane with coincides with the first symmetry plane in the neutral position of the swaying frame. The apparatus further comprises first and second boot supporting platforms which are mounted on the carrier means at the opposite sides of the second symmetry plane and have third central longitudinal symmetry planes. The distance between the second symmetry plane and each third symmetry plane exceeds the distance between the second symmetry plane and each of the aforementioned horizontal axes.

The pairs of links are preferably mirror symmetrical to each other with reference to the first plane in the neutral position of the swaying frame, and the length of each front link preferably matches the length of the respective rear link. Also, the links of the first pair are preferably at least substantially parallel to the links of the second pair.

As mentioned above, the carrier means preferably comprises a seesaw frame having first and second portions which are mirror symmetrical to each other with reference to the second plane. The seesaw frame is rockable with reference to the swaying frame about at least one second substantially horizontal axis which is disposed in the second plane. This ensures that one portion of the seesaw frame moves upwardly while the other portion of the seesaw frame moves downwardly and vice versa. The first and second platforms are mounted on the respective (first and second) portions of the seesaw frame. Such apparatus preferably further comprises means (e.g., elastically deformable shock absorbers) for limiting the rocking movements of the first and second portions of the seesaw frame with reference to the swaying frame. Still further, such apparatus preferably comprises one or more leaf springs or other suitable resilient means for biasing the seesaw frame to a neutral position in which the platforms are or can be disposed at or close to the same level.

In accordance with a presently preferred embodiment of the invention, the seesaw frame comprises an upper section and a preferably identical or similar but independent lower section as well as means for compelling the two sections to perform pivotal movements about two discrete second axes which are located in the second symmetry plane. The compelling means can comprise distancing elements which serve to maintain the two sections of the seesaw frame in two discrete parallel planes each of which includes one of the second horizontal axes. Each portion of the seesaw frame includes one-half of the upper and one-half of the lower section of such frame. Each section of the seesaw frame preferably includes a pair of longitudinally extending coupling members (e.g., rods having a circular cross-sectional outline) and such apparatus can further comprise means for varying the distance between the coupling members of each section and/or between the coupling members of the upper and lower sections. The coupling members of each section are disposed at the opposite sides of the second symmetry plane, i.e., each portion of the seesaw frame can be said to comprise at least one coupling member. The platforms can be mounted for movement lengthwise of the respective coupling member or members, and the apparatus preferably further comprises resilient means for yieldably urging the platforms to predetermined neutral positions as considered in the longitudinal direction of the respective coupling member(s).

The apparatus can further comprise pivot means which define for each of the platforms a substantially vertical pivot axis about which the respective platform is turnable relative to the corresponding portion of the seesaw frame. Such apparatus preferably also comprises springs which serve to yieldably oppose pivotal movements of the platforms from predetermined neutral positions with reference to the corresponding portions of the seesaw frame, i.e., to predetermined angular positions so that the third symmetry planes are at least substantially parallel to the first and second symmetry planes. The springs of each pair are preferably arranged to act substantially tengentially of the respective pivot means and in the opposite directions so that one spring of each pair stores energy when the other spring of the same pair dissipates energy and vice versa.

The apparatus preferably further comprises means for adjusting the bias of resilient means which urges the swaying frame to its neutral position. To this end, the main frame preferably comprises a transversely extending bridge disposed at the front or rear end of the swaying frame and serving as a support for the adjusting means. The adjusting means can comprise a holder (e.g., a horizontal beam) which is directly or indirectly connected with the resilient means, a nut in the bridge, a substantially vertical feed screw which meshes with the nut and is connected with the holder, and means for rotating the feed screw with reference to the nut to thereby move the holder up or down and to thus increase or reduce the bias of the resilient means. The means for rotating the feed screw can comprise a crank which includes or constitutes a seat for the user of the apparatus.

The platforms are preferably turnable with reference to the carrier means (most preferably about the axes of the corresponding coupling members) about longitudinally extending axes which are parallel or nearly parallel to the horizontal axes of the means which connect the carrier means to the upper end portions of the links. Such apparatus preferably further comprises means for yieldably biasing the platforms to predetermined neutral positions with reference to the swaying frame, i.e., to predetermined angular positions.

In accordance with a presently preferred embodiment of the invention, the versatility of the apparatus is highly satisfactory if the platforms are tiltable within limites relative to the swaying frame about longitudinal axes (of the aforementioned coupling members), if the platforms are turnable within limits with reference to the carrier means about substantially vertical axes, if each of the platforms is shiftable lengthwise within limits relative to the carrier means in parallelism with the horizontal pivot axes for the carrier means, and if each platform is movable within limits up and down with reference to the swaying frame. As mentioned above, resilient means can yieldably oppose at least one of the just mentioned tilting, turning, shifting and up-and-down movements of the platforms, and some or all of the resilient means are preferably adjustable to select the forces which the user must overcome in order to induce the platforms to perform the respective movements with reference to the swaying frame and/or carrier means.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 8 is a side elevational view of the seesaw frame as seen from the left-hand side of FIG. 6;

FIG. 9 shows the structure of FIG. 6 but with the seesaw frame in one of its end positions;

DESCRIPTION OF THE PREFERRED EMBODIMENTS

Figure 1:
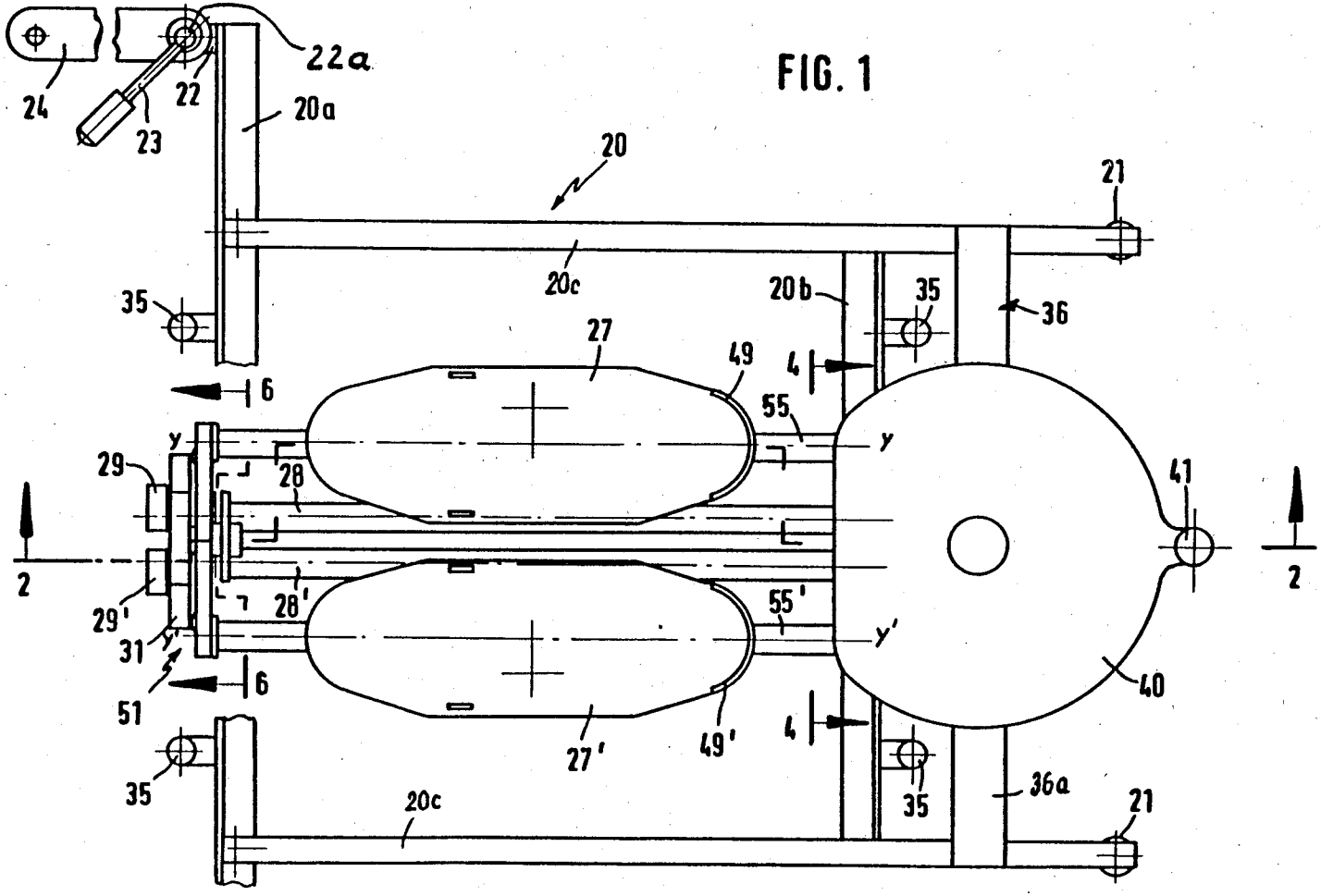
FIG. 1 is a plan view of an apparatus which embodies the invention with the housing removed and with a portion of the main frame broken away.
Figure 2:
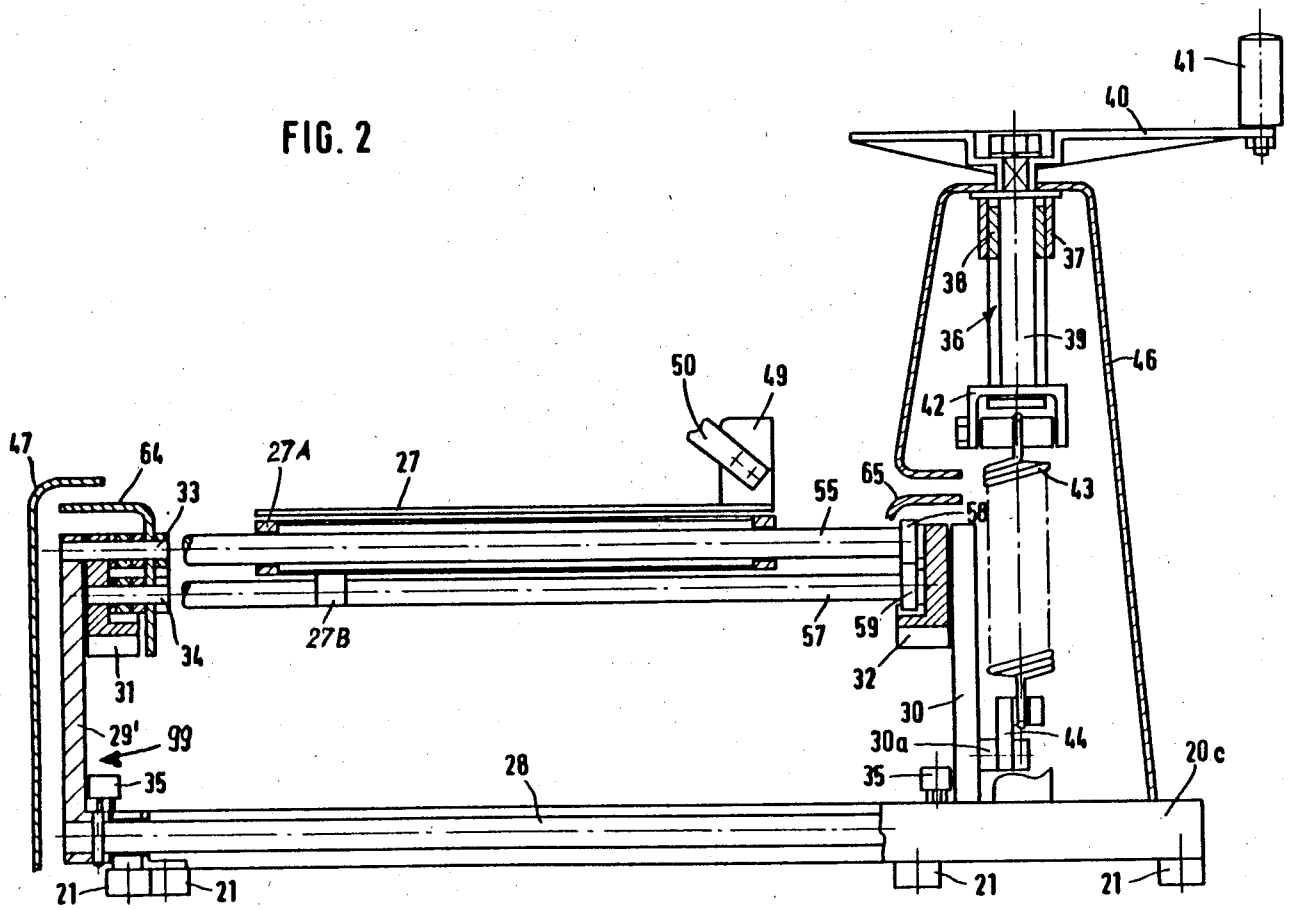
FIG. 2 is a longitudinal vertical sectional view as seen in the direction of arrows from the line 2—2 of FIG. 1.
Figure 3:
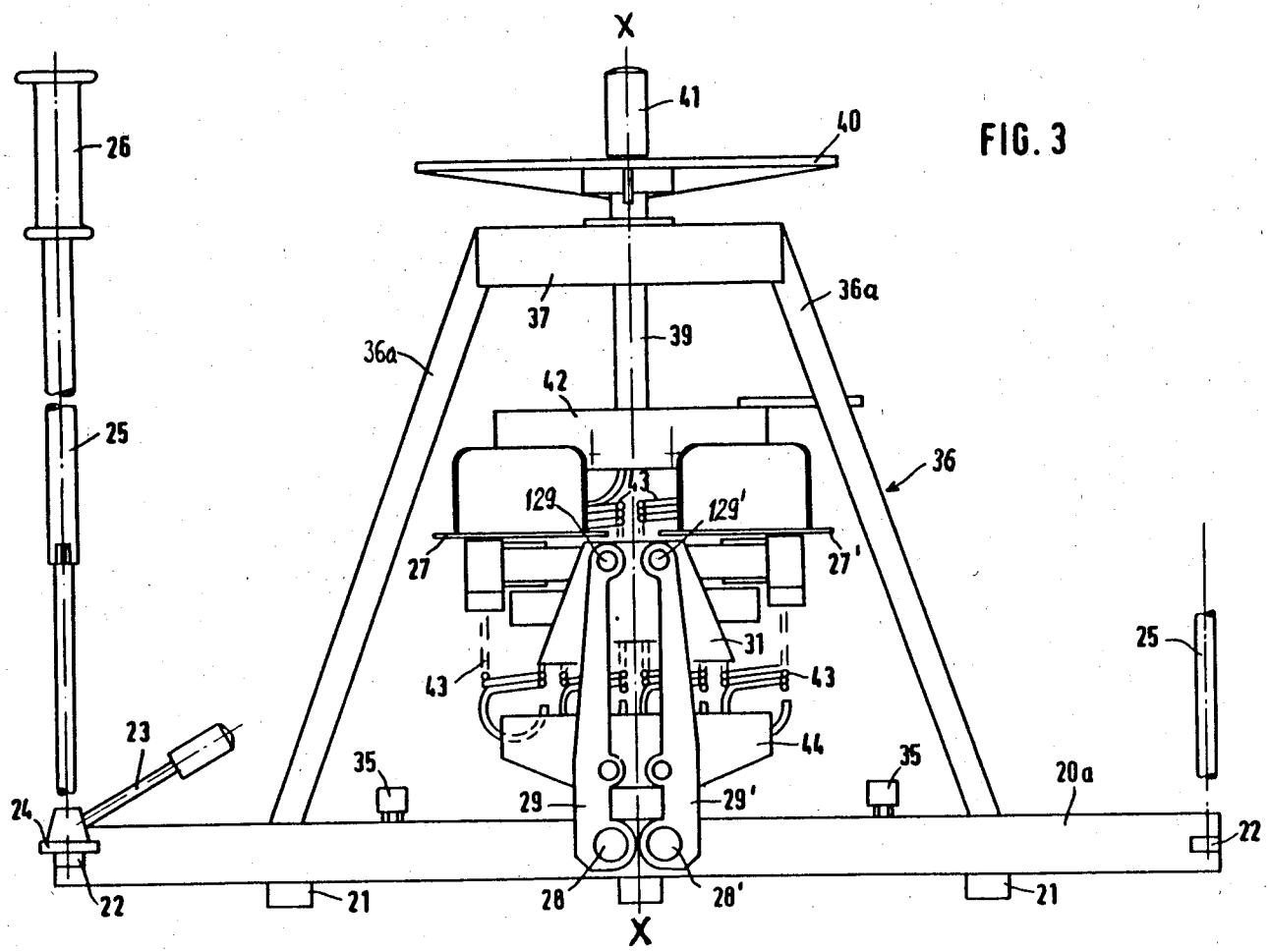
FIG. 3 is a front elevational view of the apparatus as seen from the left-hand side of FIG. 1, with portions of the poles broken away and with the housing removed.

Referring first to FIGS. 1 to 3, there is shown an apparatus which can be used for the practice of skiing, especially for practicing downhill or slalom runs, and more particularly, for exercising those parts of the body whose conditioning is especially important for a safe and satisfactory downhill or slalom run. The apparatus comprises a stationary main frame 20 which is assembled of profiled metallic members and carries floor-contacting legs 21 of rubber or another suitable material which not only exhibits a certain amount of resiliency but also reduces the likelihood of slippage of the frame 20 along the floor. The frame 20 includes a transversely extending front frame member 20*a* whose end portions extend laterally beyond the corresponding longitudinal frame members 20*c*. The free end of each end portion of the front frame member 20*a* is provided with a forwardly extending lug 22 carrying an upwardly extending externally threaded stub shaft 22*a* mating with the nut of a clamping handle 23 which can hold in a selected angular position a lever 24 extending forwardly of the respective end portion of the frame member 20*a*. The front end portion of each lever 24 supports a variable-length pole 25 which is assembled of several telescopically connected sections the uppermost one of which carries a handgrip member 26. The length of the poles 25 can be varied within a wide range so as to place the handgrip members 26 to optimum positions for engagement by the hands of the person utilizing the apparatus. Moreover, the nuts of the clamping handles 23 can be detached from the respective stubs 22*a* to allow for detachment of the levers 24 and poles 25 in order to reduce the overall dimensions of the apparatus for the purpose of storage or transport. It is also possible to pivot the levers 24 in front of the frame member 20*a* so that the apparatus occupies less space even if the poles 25 are not completely detached prior to placing the apparatus into storage or prior to transport of the apparatus to a dealer, to a customer or to another destination. The reference characters 27 and 27′ denote two plate-like platforms which serve as a means for supporting the boots of the person using the apparatus.

Figure 4:
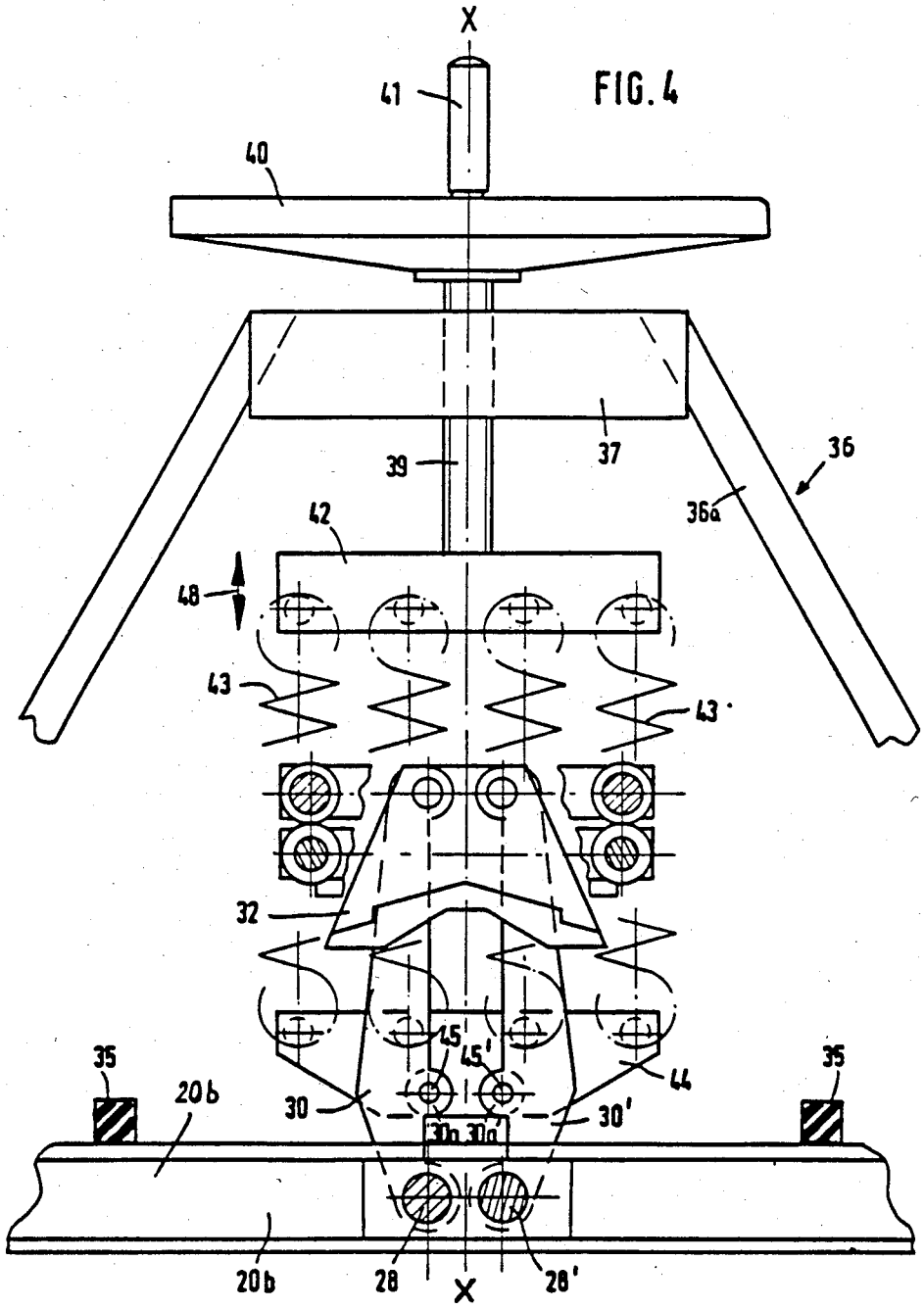
FIG. 4 is an enlarged fragmentary transverse vertical sectional view as seen in the direction of arrows from the line 4—4 of FIG. 1, showing the swaying frame of the apparatus in its neutral position.
Figure 5:
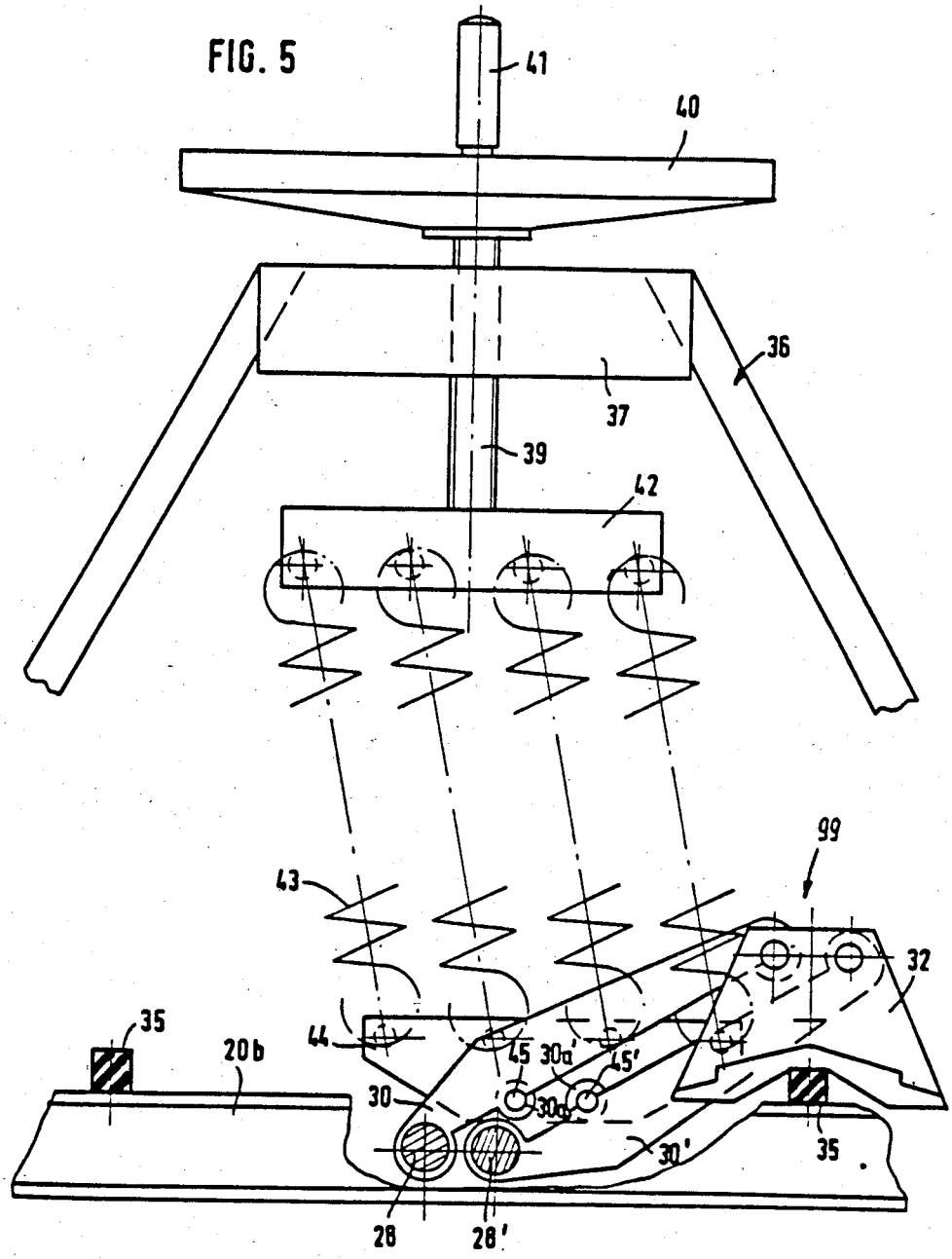
FIG. 5 shows the structure of FIG. 4 but with the swaying frame illustrated in one of its end positions.

The apparatus which is shown in FIGS. 1 to 3 preferably comprises two halves which are mirror symmetrical to one another with reference to a longitudinal vertical symmetry plane X—X extending midway between the platforms 27, 27′ and at right angles to the front frame member 20*a*. The main frame 20 further includes a transversely extending rear frame member 20*b* which is parallel to the front frame member 20*a* and need not extend laterally beyond the longitudinal frame members 20*c*. The frame members 20*a*, 20*b* are connected to each other by two parallel horizontal shafts 28, 28′ which are disposed at least substantially midway between the longitudinal frame members 20*c*. The front end portions of the shafts 28, 28′ extend forwardly beyond the frame member 20*a* and define pivot axes for two mirror symmetrical upwardly extending links 29, 29′ of identical length. The rear end portions of the shafts 28, 28′ extend rearwardly beyond the frame member 20*b* and respectively define pivot axes for two additional mirror symmetrical links 30, 30′ (see also FIGS. 4 and 5). The links 29, 30 are non-rotatably secured to the respective end portions of the shaft 28 by radially extending pins or the like (not shown), and the links 29′, 30′ are non-rotatably secured to the respective end portions of the shaft 28′ in similar fashion. The upper end portions of the front links 29, 29′ are turnably connected with a trapeziform plate-like front end wall 31 whose width increases in a direction downwardly toward the front frame member 20*a*, and the upper end portions of the rear links 30, 30′ are articulately connected with a similar trapeziform plate-like rear end wall 32. The end walls 31 and 32 constitute component parts of a swaying frame 99 which can move back and forth with the links 29–30′ about the axes of the shafts 28 and 28′, i.e., to the left and to the right of the symmetry plane X—X as viewed in FIG. 3. The distance between the axes of the pivot members 129, 129′ which articulately connect the links 29, 29′ to the front end wall 31 is the same as that between the axes of the shafts 28, 28′. The means for rigidly connecting the end walls 31, 32 to each other comprises two elongated parallel horizontal connecting rods 33, 34 which are disposed at different levels (see FIG. 2) and cooperate with the links 29–30′ to ensure that the orientation of the swaying frame 99 (when the links 29–30' pivot about the axes of the respective shafts 28, 28') remains unchanged. At such time, the end walls 31, 32 move along arcuate paths back and forth alternately toward the one and the other longitudinal frame member 20*c* at a level above the main frame 20. The extent of such movements of the swaying frame 99 including the end walls 31 and 32 is limited by elastic stops 35 which are mounted on the front and rear frame members 20*a*, 20*b*. The connecting rods 33 and 34 constitute an optional feature of the swaying frame 99 because the aforediscussed nature of back-and-forth movements of this frame is ensured by the links 29–30' in cooperation with the shafts 28, 28' and pivot members which secure the upper end portions of the links to the respective end walls 31, 32. The main purpose of the connecting rods 33, 34 is further stiffen or reinforce the frame 99 so as to further enhance the stability and safety of the apparatus. As can be seen in FIGS. 4 and 5, the configuration of those edge faces of the rear links 30, 30' which face one another is such that these links cannot interfere with pronounced back-and-forth movements of the frame 99 all the way into contact with the elastic stops 35 on the frame members 20*a* and 20*b*. The same holds true for the configuration of those edge faces of the front links 29, 29' which face one another. To this end, the just discussed edge faces of the links 29–30' are provided with cutouts so as to provide ample room for swaying of each link through an angle of nearly 180°.

The main frame 20 of the apparatus further comprises a transversely extending bridge 36 which extends between the longitudinal frame members 20*c* to a level well above the general plane of the main frame (see FIGS. 2 and 3). The bridge 36 is an inverted U-shaped structure (actually, the shape of the bridge resembles a trapeze) having two upwardly sloping convergent flanges 36*a* whose lower end portions are affixed to the respective longitudinal frame members 20*c* and the upper end portions of which are rigidly secured to one another by a horizontal web 37. The central portion of the web 37 includes or constitutes a spindle nut 38 which has a tapped vertical through bore and is in mesh with the external threads of a rotary feed screw 39. The upper end portion of the feed screw 39 is connected with a crank 40 having an eccentric handle 41 which can be actuated by hand in order to move the feed screw 39 axially toward or away from the general plane of the main frame 20. The crank 40 constitutes or includes a seat for the person using the exercising apparatus.

The lower end portion of the feed screw 39 is rotatably connected with the central portion of a transversely extending horizontal holder or beam 42 which serves as a means for expanding or for permitting contraction of relatively large and strong prestressed coil springs 43. The lower end portions of the coil springs 43 are connected with a second horizontal holder or beam 44 which has pins 45, 45' extending forwardly into complementary sockets 30*a*, 30*a'* of the rear links 30 and 30'. By rotating the crank 40 via handle 41, the user of the apparatus can select the tension of the springs 43, i.e., the resistance which the user encounters to swaying of the frame 99 including the end walls 31 and 32 between the two pairs of elastic stops 35 on the frame members 20*a* and 20*b*.

The bridge 36, the major part of the feed screw 39, the nut 38, the beams 42, 44 and the springs 43 are partially confined in a housing or shell 46 which is secured to the main frame 20 as well as to the bridge 36. A second housing or shell 47 constitutes or resembles a shroud which partially confines the front portion of the frame 99. The purpose of the housings 46, 47 is to enhance the appearance of the apparatus, to conceal those parts which require oiling or another type of lubrication, and to reduce the likelihood of injury to the user.

FIGS. 4 and 5 show on an enlarged scale the bridge 36, the springs 43, the means for tensioning the springs 43, as well as the rear portion of the frame 99. FIG. 4 shows the frame 99 in a neutral position in which the springs 43 extend substantially vertically, and FIG. 5 shows these springs in stressed condition with the swaying frame 99 deflected all the way to one of its two end positions, namely, into abutment with the corresponding elastic stops 35 on the frame members 20*a* and 20*b*. Thus, when the frame 99 assumes the end position of FIG. 5 (or the other end position), the springs 43 store a maximum amount of energy. The arrow 48 denotes in FIG. 4 the directions in which the upper holder or beam 42 can be moved by the feed screw 39 in order to change the initial stressing of the springs 43. Such adjustments will be carried out in order to conform the initial stressing of the springs 43 to the weight of the person using the apparatus as well as to select the effort which is required to move the frame 99 from the neutral position of FIG. 4.

The platforms 27, 27' are respectively provided with arcuate abutments 49, 49' for the heels of the boots which are worn by the person using the apparatus as well as with straps 50 (see FIG. 2) which can be caused to extend over the insteps of the respective feet. The straps 50 are secured to the respective abutments 49, 49'.

The platforms 27 and 27' are mounted on a third frame 51 (hereinafter called seesaw frame to distinguish from the main frame 20 and from the swaying frame 99) the details of which are shown in FIGS. 6 to 9. The frame 51 is articulately connected to the swaying frame 99, and its rear portion is a mirror image of its front portion. The same applies for the front and rear portions of the frame 99.

Figure 6:
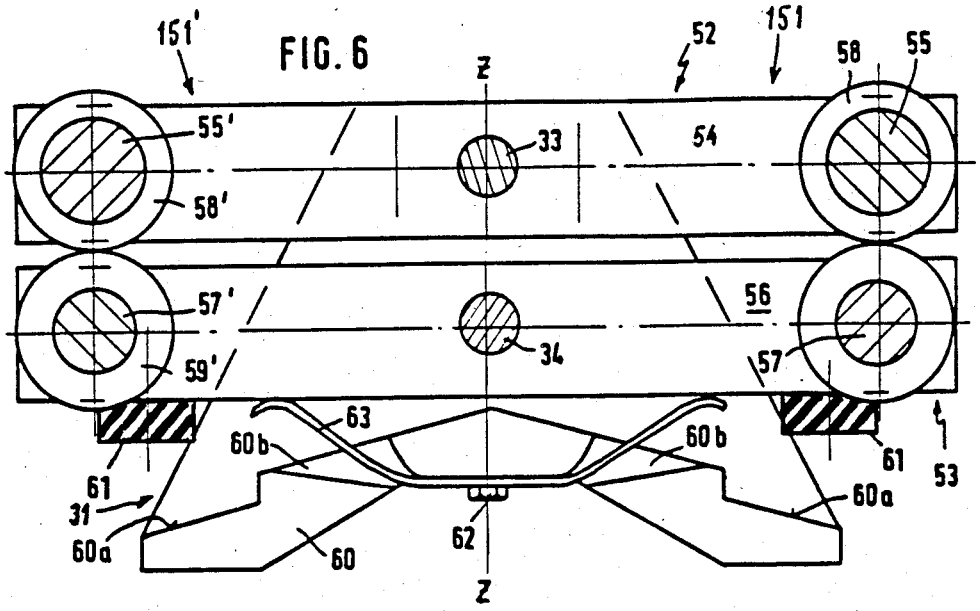
FIG. 6 is an enlarged fragmentary transverse vertical sectional view as seen in the direction of arrows from the line 6—6 of FIG. 1, with the seesaw frame shown in its neutral position.
Figure 7:
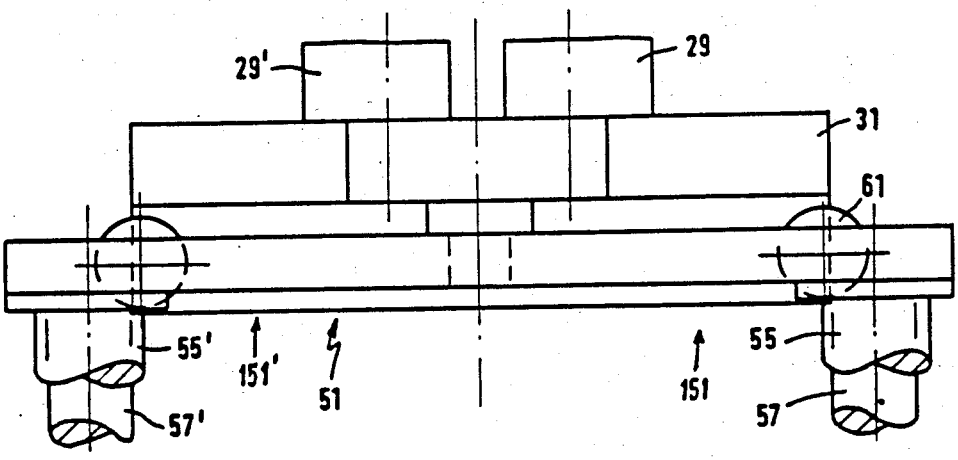
FIG. 7 is a plan view of the structure which is shown in FIG. 6.

In the embodiment which is shown in FIGS. 1 to 9, the seesaw frame 51 comprises an upper section 52 and an independent lower section 53. The sections 52, 53 are respectively mounted on the upper and lower connecting rods 33, 34 of the frame 99 and are compelled to rock in parallelism with each other by distancing elements which ensure that the lower section 53 invariably remains parallel to the upper section 52, i.e., that such sections are invariably located in two parallel planes. More specifically, the upper section 52 of the frame 51 comprises a front and a rear transverse brace 54 as well as two elongated rod-like parallel coupling members 55, 55' which connect the end portions of the front brace 54 with the end portions of the rear brace 54. The median portions of the braces 54 are free to pivot back and forth on the upper connecting rod 33. The lower section 53 of the frame 51 comprises front and rear transverse braces 56 and elongated rod like coupling members 57, 57' which are parallel to each other and are respectively adjacent to the coupling members 55, 55'. The braces 56 are free to pivot back and forth on the lower connecting rod 34. The coupling members 55, 55', 57, 57' respectively carry disc-shaped distancing elements 58, 58', 59, 59' which ensure that the braces 54 are invariably parallel to the braces 56 irrespective of the inclination of these braces with reference to the main frame 20. The distancing elements 58, 58' continuously abut against the respective distancing elements 58', 59' and such distancing elements can constitute idler rollers to reduce the resistance to rocking of the seesaw frame 51. Split rings, cotter pins or other suitable means can be provided to hold the distancing elements 58–59' against axial movement along the respective coupling members 55, 55', 57 and 57'. The distancing elements 58–59' allow for rocking of the two sections 52, 53 of the frame 51 without allowing the two sections to come into actual contact with one another. Thus, the distance between the coupling members 55, 57 and 55', 57' is constant in each angular position of the braces 54, 56 relative to the respective connecting rods 33, 34. The plane including the axes of the upper coupling members 55, 55' is invariably parallel to the plane including the axes of the lower coupling members 57, 57'. Such planes respectively include the axes of the connecting rods 33 and 34. FIG. 6 shows the sections 52, 53 of the seesaw frame 51 in two parallel horizontal planes, and FIG. 9 shows such sections in two inclined planes which are parallel to each other. These sections can seesaw between the end positions which are shown in FIG. 9 by solid lines and the end positions which are indicated in FIG. 9 by two parallel phantom lines. The sections 52, 53 assume the horizontal positions of FIG. 6 in the neutral position of the seesaw frame 51.

The apparatus further comprises means for limiting the extent of movement of the seesaw frame 51 relative to the swaying frame 99 including the end walls 31 and 32. Such limiting means comprises projections 60 which are provided on the end walls 31, 32 and extend below the braces 56 of the frame 51. The projections 60 comprise suitably inclined stop faces **60*a* (see particularly FIG. 6) for elastic protuberances 61 at the undersides of the braces 56. The protuberances 61 can be said to constitute simple shock absorbers which damp the last stage of movement of the seesaw frame 51** to each of its end positions.

Still further, the apparatus comprises means for automatically returning the frame 51 to and for normally maintaining the frame 51 in the neutral position of FIG. 6. Such returning means comprises suitably configurated leaf springs 63 which are secured (by bolts 62 or analogous fasteners) to the projections 60 midway between the respective stop faces **60*a* and have pairs of prongs with convex upper surfaces abutting against the undersides of the corresponding braces 56. When the seesaw frame 51 assumes the one or the other end position, the prongs of the leaf springs 63 enter the corresponding recesses 60*b* which are provided therefor in the respective projections 60**.

As can be seen in FIGS. 1 and 2, the platforms 27, 27' are respectively mounted on the upper coupling members 55, 57 and 55', 57' of the seesaw frame 51. Each of these platforms is movable lengthwise of the corresponding coupling members, i.e., toward the front end wall 31 or toward the rear end wall 32 of the frame 99. Moreover, and since the frame 51 can be rocked between the two end positions one of which is fully shown in FIG. 9, the user of the apparatus can lift or lower the right or the left foot and the corresponding boot by causing the frame 51 to move from the neutral position of FIG. 6. The foot which exerts pressure upon the respective platform 27 or 27' moves downwardly. However, the platforms 27, 27' do not or need not change their orientation in response to rocking of the frame 51 because each of these platforms is secured to two coupling members which are parallel to and are disposed one above the other. This can be readily seen for the platform 27 by looking at FIG. 2 wherein the platform 27 is provided with a first sleeve 27A surrounding the upper coupling member 55 and the first sleeve carries a second sleeve 27B surrounding the lower coupling member 57.

The apparatus of the present invention can be used as a means for practicing different types of races, e.g., downhill and slalom or giant slalom. Therefore, it may be advantageous for the user to move his or her feet nearer to or further away from each other (as considered in the longitudinal direction of the main frame 20). For this purpose, the braces 54, 56 may be of the extendable and contractible (variable length) type.

FIGS. 1 and 2 further show portions of additional housings or shells 64, 65 which respectively cooperate with the aforementioned housings 47, 46 to further contribute to safety and eye-pleasing appearance of the apparatus. The upper portion of the housing 64 is partially overlapped by the upper portion of the housing 47, and the housing 64 conceals or overlies the inner sides of the front links 29, 29'. Moreover, the housing 64 conceals the means which connect the swaying frame 99 with the front portion of the seesaw frame 51. The housing 65 conceals the means for connecting the frame 99 with the rear portion of the frame 51. The housings 64, 65 further cooperate with the housings 46, 47 to reduce the likelihood of soiling of the user's hands, boots or garmets by lubricant.

The vertical plane Z—Z (FIG. 6) is the longitudinal symmetry plane of the swaying frame 99 and coincides with the plane X—X when the swaying frame assumes the neutral position of FIG. 4. The longitudinal symmetry planes Y—Y and Y'—Y' of the platforms 27 and 27' are disposed at the opposite sides of the symmetry plane Z—Z, and the distance between the plane Z—Z and each of the planes Y—Y, Y'—Y' exceeds the distance between the plane Z—Z and the horizontal axis of the pivot member 129 or 129'. The seesaw frame 51 can be said to include a first portion 151 at one side and a mirror symmetrical second portion 151' at the other side of the symmetry plane Z—Z. The portion 151 includes one-half of each of the sections 52, 53, and the portion 151' includes the other half of each of these sections. The platform 27 is mounted on and can move up and down with the portion 151, and the platform 151'. The axes of the connecting rods 33, 34 are parallel to the axes of the pivot members 129, 129' and to the axes of pivot members which connect the rear end wall 30 with the upper end portions of the links 30, 30'. The parts 31 to 34 can be said to constitute a carrier for the seesaw frame 55, and such carrier is part of the swaying frame 99 which sways about the pivot axes defined by the shafts 28, 28' while the seesaw frame pivots about the horizontal axes of the connecting rods 33, 34.

The aforediscussed relationship of the distances between the planes Z—Z and Y—Y, Y'—Y' on the one hand and the plane Z—Z and the axes of the pivot members 129, 129' on the other hand renders it possible to move the portion 151 of the seesaw frame 51 downwardly (with attendant upward movement of the portion 151') or vice versa by the simple expedient of shifting the body weight of the person using the improved practicing or exercising apparatus. By shifting the weight of his or her body onto the one or the other foot, the person using the apparatus must overcome the resistance of the springs 63 which tend to maintain the frame 51 in the neutral position of FIG. 6. The other movements of the platforms 27, 27' (namely tilting movements about the respective connecting rods 55, 55', longitudinal movements in the axial direction of the respective connecting rods 55, 55', and pivotal movements about the axes of the respective pivot pins 75, 75') against the opposition of the respective resilient means enable the user to practice additional movements which will be performed on a ski slope and to simultaneously build the corresponding muscles, especially in the thighs and the buttocks. Each and every spring is or can be adjusted so as to change its bias depending on the age and/or sex and/or weight and/or degree of advancement of the person using the apparatus.

A person resting his or her boots on the platforms 27, 27' can cause the seesaw frame 51 to rock to the solid-line end position of FIG. 9 by exerting pressure with the respective foot. At the same time, such person can cause the swaying frame 99 to leave the neutral position of FIG. 4 by causing the springs 43 to store additional energy so that the parts 31, 32, 33 and 34 sway about the pivot axes which are defined by the shafts 28 and 28'. For example, the person using the improved apparatus can move the frame 99 to the position which is shown in FIG. 5 by applying one-sided pressure to the lower beam 44 via rear end wall 32 of the frame 99. By alternatively depressing the platforms 27, 27', the person using the apparatus strengthens the muscles of his or her thighs and buttocks. Furthermore, such exercise is beneficial to the circulatory system.

In order to even more accurately simulate the conditions which prevail during a downhill or slalom race, especially to more accurately imitate the various swaying movements which are performed during skiing, the apparatus of the present invention can be further equipped with means for yieldably opposing movements of the platforms 27, 27' from horizontal planes so that the boots can assume positions corresponding to those when the skis are running on edge rather than lying flat against the snow-covered ground. Moreover, it is desirable and advantageous to construct and assemble the apparatus in such a way that the feet of the user can perform other exercises, preferably against the resistance of resilient means. Such additional exercises can involve turning the tips of the toes inwardly while exerting pressure with the heels as well as slightly or extensively shifting the feet relative to each other in the longitudinal direction of the apparatus by moving forwardly that foot which is at the inner side of the curve during skiing. In order to carry out such additional exercises, the platforms can be secured to the swaying frame 51 in a number of different ways as shown in FIGS. 10 to 19. Since the platforms 27 and 27' are mirror symmetrical to one another, it suffices to describe the means for facilitating and yieldably opposing various movements of one of these platforms.

Figure 11:
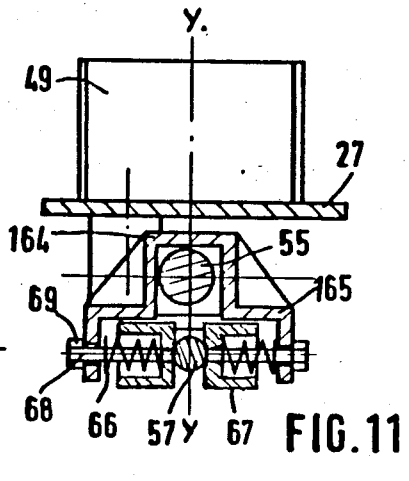
FIG. 11 is a transverse vertical sectional view as seen in the direction of arrows from the line 11—11 of FIG. 10, with the platform shown in neutral position.
Figure 12:
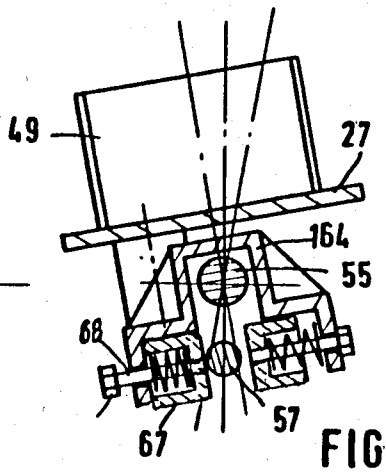
FIG. 12 illustrates the structure of FIG. 11 with the platform shown in one of its end positions.
Figure 10:
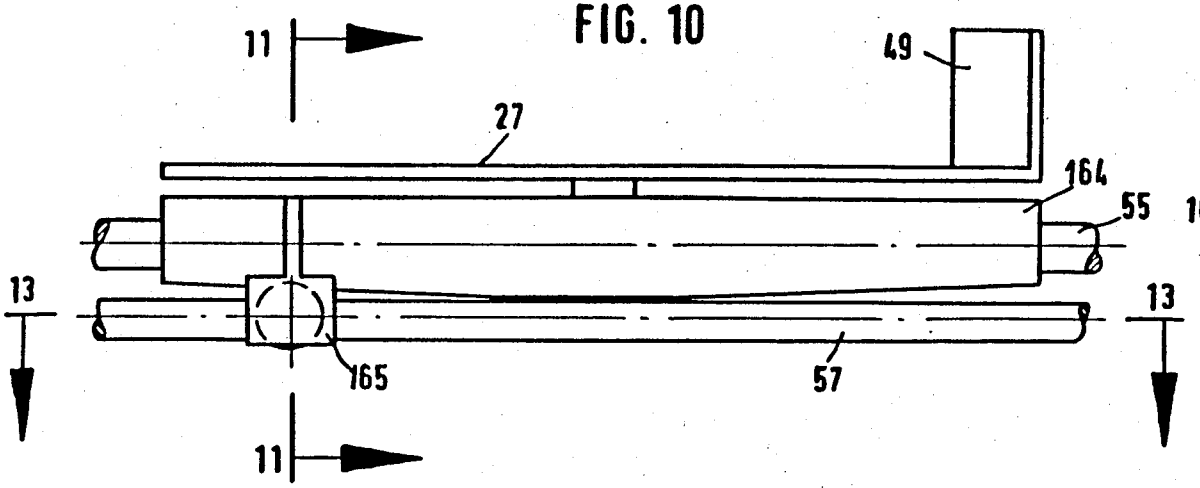
FIG. 10 is a side elevational view of one of the platforms and of the means for turnably supporting the platform on one of the corresponding coupling members.
Figure 13:
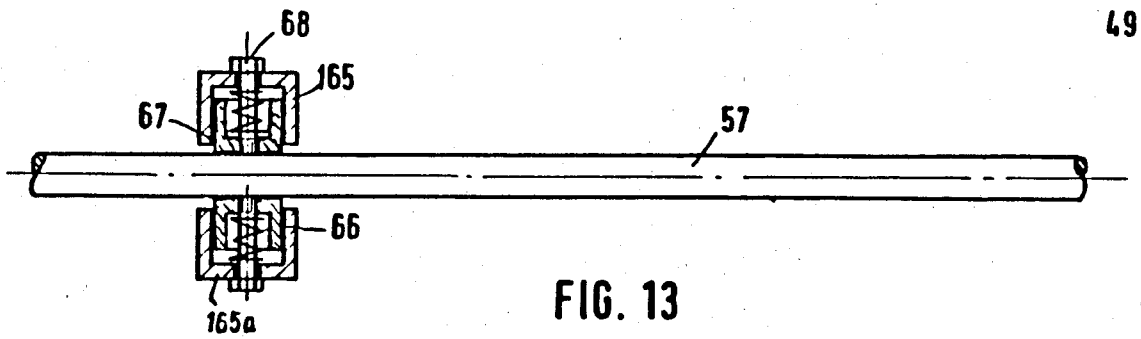
FIG. 13 is a horizontal sectional view as seen in the direction of arrows from the line 13—13 of FIG. 10.

FIGS. 10 to 13 illustrate the manner in which the platform 27 can be caused to tilt back and forth about the axis of the coupling member 55. As shown in FIG. 2, the platform 27 can be mounted on two coupling members, namely on the coupling member 55 of the upper section 52 and on the coupling member 57 of the lower section 53 of the seesaw frame 51. First of all, the platform 27 is or can be mounted on an elongated sleeve 164 in such a way that it can turn relative thereto about a vertical axis. The sleeve 164 corresponds to the sleeve 27A of FIG. 2 and slidably surrounds the upper coupling member 55 of FIGS. 10 to 13. Since the coupling member 55 is a solid cylindrical rod, the sleeve 164 can turn about its axis as long as such movement is not prevented by the lower coupling member 57 whose diameter is smaller than that of the coupling member 55. As can be readily seen in FIGS. 11 and 12, the sleeve 164 supports or is integral with two casings 165 which flank the lower coupling member 57 and contain springs 66 tending to maintain the platform 27 in a horizontal position. The length of the casings 165 can be a small fraction of the axial length of the sleeve 164. Each of the illustrated springs 66 is a relatively strong coil spring which reacts against a downwardly extending outer wall **165*a* of the respective casing 165 and bears against the bottom wall of a hollow cupped plunger or pusher 67 arranged to directly contact the corresponding side of the coupling member 57. Each spring 66 surrounds a guide post 68 in the form of a pin which extends outwardly through the respective outer wall 165*a* and has an externally threaded outer end mating with a nut 69. The post 68 is reciprocably guided in the respective outer wall 165*a* and its inner end portion is connected to the corresponding pusher 67. When the platform 27 is held in the horizontal position of FIG. 11, the springs 66 are free to expand so that both pushers 67 bear against the coupling member 57 and the nuts 69 bear against the outer sides of the respective outer walls 165*a*. The bias of the left-hand spring 66 of FIG. 11 is the same as that of the right-hand spring; therefore, these springs normally maintain the plate 27 in the horizontal position of FIG. 11. However, the user of the apparatus can twist his or her feet so as to cause the sleeve 164 to turn clockwise or counterclockwise, as viewed in FIG. 11, e.g., to the position which is shown in FIG. 12. This entails a more or less pronounced stressing of one of the springs 66 and a corresponding reduction of the bias of the other spring. The state of equilibrium is restored automatically when the user ceases to twist his or her ankle so that the platform 27 can reassume the neutral position of FIG. 11**.

Figure 16:
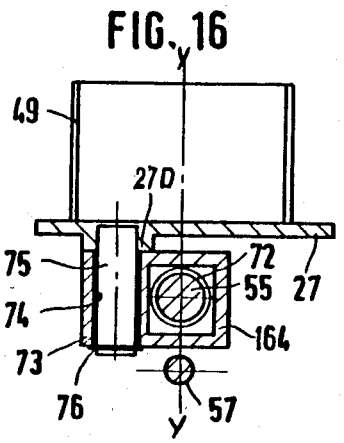
FIG. 16 is a transverse vertical sectional view as seen in the direction of arrows from the line 16—16 of FIG. 15.
Figure 15:
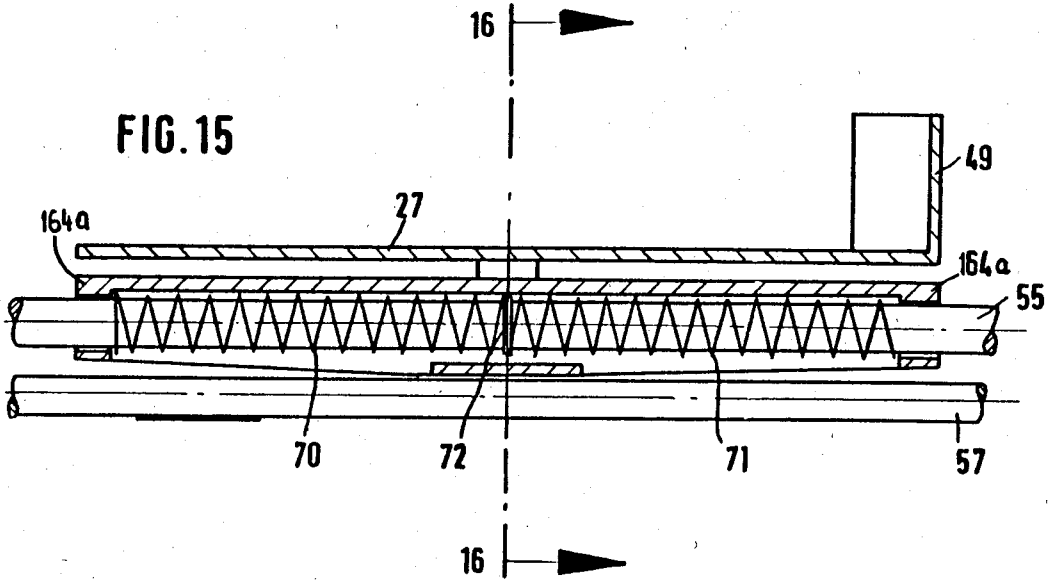
FIG. 15 is a longitudinal vertical sectional view as seen in the direction of arrows from the line 15—15 of FIG. 14.
Figure 14:
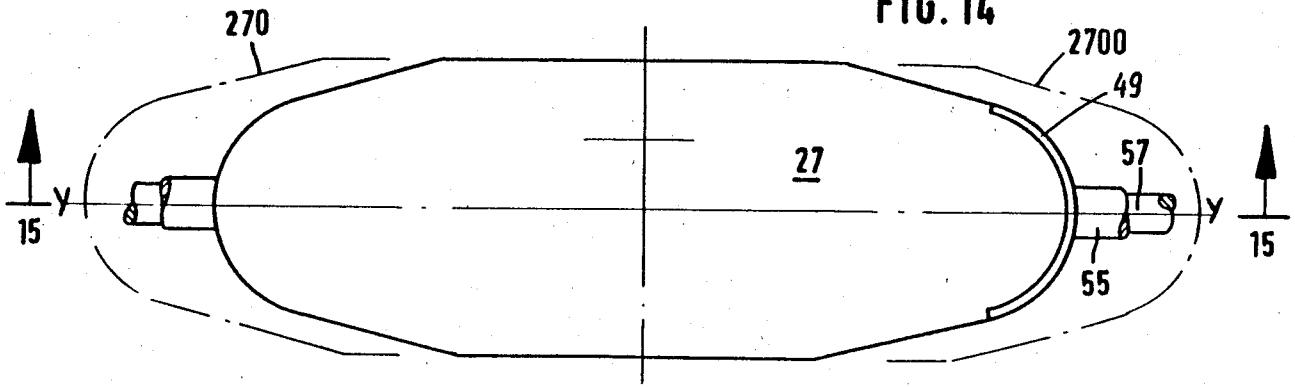
FIG. 14 is a plan view of a platform and of a portion of the seesaw frame, the front and rear end positions of the platform being indicated by phantom lines.

FIGS. 14 to 16 illustrate the manner in which the platform 27 is movable in the longitudinal direction of the corresponding coupling members 55 and 57 to and from a central or neutral position. The left-hand end position of the platform 27 is indicated in FIG. 14 by phantom lines, as at 270, and the phantom lines 2700 indicate the other (right-hand) end position of the platform 27. As can be seen in FIG. 15, the end portions **164*a* of the sleeve 164 constitute friction bearings which snugly surround the upper coupling member 55 and confine two coil springs 70, 71 which surround the coupling member 55. A split ring 72 is recessed into a circumferential groove of the coupling member 55 and is located midway between the friction bearings 164*a* when the platform 27 assumes the neutral position of FIG. 15. The split ring 72 can be said to constitute a collar of the coupling member 55, and its purpose is to stress the spring 70 or 71 in conjunction with the corresponding friction bearing 164*a*, depending upon the direction of movement of the platform 27 longitudinally of the seesaw frame including the coupling member 55. The bias of the spring 71 preferably matches that of the spring 70 so that the two springs normally maintain the platform 27 in the neutral position of FIG. 15 as long as the user of the apparatus does not pull the platform 27 forwardly toward the end position 270 of FIG. 14 (by the corresponding instep strap 50) or as long as the user does not push the platform 27 toward the end position 2700 by way of the heel abutment 49**.

Figure 18:
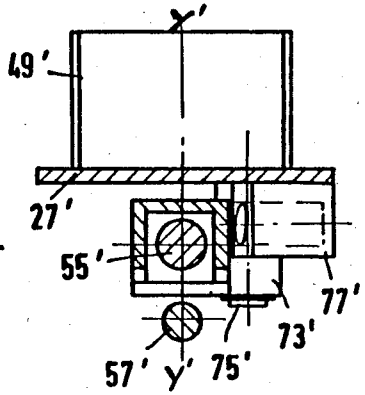
FIG. 18 is a transverse vertical sectional view as seen in the direction of arrows from the line 18—18 of FIG. 17.
Figure 17:
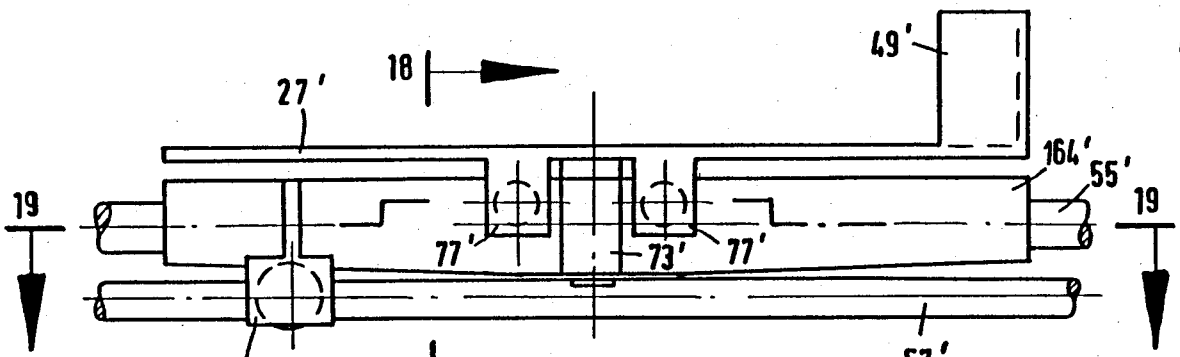
FIG. 17 is a side elevational view of one of the platforms, showing the means which enables the platform to turn about a substantially vertical axis.
Figure 19:
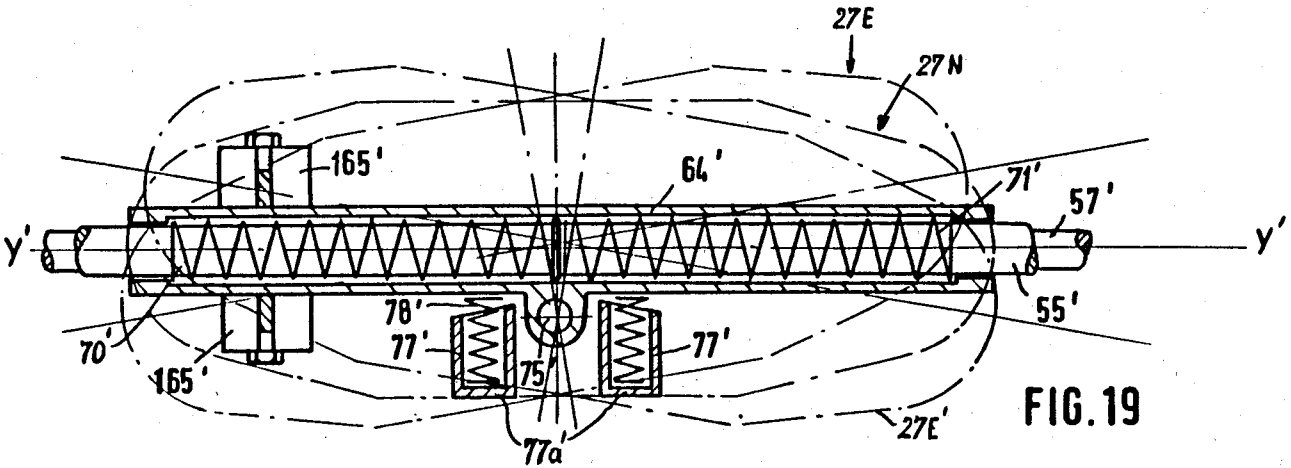
FIG. 19 is a horizontal sectional view as seen in the direction of arrows from the line 19—19 of FIG. 17.

FIG. 16 illustrates one presently preferred mode of separably securing the sleeve 164 to the platform 27. The securing means includes a hollow casting 73 which is preferably an integral part of the sleeve 164 and is disposed at one side of the coupling member 55. The casting 73 defines a hole 74 for a pivot pin 75 which extends at right angles to the plane of the platform 27 and the upper end portion of which extends into a socket 27D which is provided in the platform in register with the hole 74. The upper end portion of the pivot pin 75 is a press fit in the socket 27D, and the lower end portion of this pin extends downwardly beyond the casting 73 and has a circumferential groove for a split ring 76 which releasably holds the pin in the hole 74. The structure of FIG. 16 constitutes a simple but reliable means for separably securing the sleeve 164 to the platform 27 as well as for preventing any movements of the platform with reference to such sleeve except an angular movement about the axis of the pivot pin 75. In order to prevent excessive angular movements of the platforms relative to the corresponding sleeves, the improved apparatus preferably further comprises means for yieldably opposing turning of the platforms about the axes of the corresponding pivot pins. This is shown in FIGS. 17 to 19 in connection with the platform 27' and the corresponding sleeve 164'. The provision of some means for limiting or opposing angular movements of the platforms about the respective pivot pins (note the pin 75' in FIGS. 18 and 19) is desirable and advantageous because this reduces the danger of injury to the person using the apparatus.

The underside of the platform 27' is provided with casings 77' which flank the pivot pin 75' and each of which contains a coil spring 78'. The casings 77' can form integral parts of the platform 27' which can constitute a casting or forging made of steel or any other suitable alloy. The inner convolutions of the springs 78' react against the bottom end walls 77a' of the corresponding casings 77' and the outer convolutions of such springs bear against the side wall of the sleeve 164'. The bias of the spring 78' at one side of the pivot pin 75' matches the bias of the other spring 78' so that these springs normally cooperate and maintain the platform 27' in a neutral position 27N which is shown in FIG. 19 by phantom lines. By applying a requisite force to the platform 27' through the medium of the heel abutment 49' and the corresponding strap 50 (not shown in FIGS. 17 to 19), the user of the apparatus can move the platform 27' about the axis of the pivot pin 75' between the end positions 27E and 27E' (both indicated in FIG. 19 by phantom lines). Such movements of the platform 27' from the neutral position 27N entail compression of one of the springs 78' and a commensurate expansion of the other spring 78'. This exercise is helpful because it enables the foot to overcome forces which invariably develop or are likely to develop in the course of a downhill or slalom run.

It will be readily appreciated that the basic apparatus of the present invention (such basic apparatus preferably comprises the swaying frame 99 and the seesaw frame 51) can be equipped with one or more additional features, such as those respectively shown in FIGS. 10–13, 14–16 and 17–19. As shown in FIGS. 17 and 19, the platform 27' is equipped with means for yieldably opposing the movements about the axis of the pivot pin 75' as well as with means for yieldably opposing movements of the platform in a manner as described for the platform 27 in connection with FIGS. 12–14. Furthermore, the sleeve 164' of FIGS. 17–19 is movable forwardly or backwards against the opposition of the spring 70' or 71'. All such parts which are denoted in FIGS. 17–19 by various reference characters but are not specifically referred to are identified by numerals which are used in FIGS. 12 to 16 but each such numeral is followed by a prime.

The improved exercising apparatus exhibits a number of important advantages. Thus, the apparatus is or can be relatively simple and compact so that it occupies little room when it is set up for actual use, in storage or during transport. Secondly, the apparatus is highly versatile so that it can replace two or more conventional apparatus. Thirdly, the apparatus is readily adjustable so as to be ready for use by children, adolescents or adults, by male or female skiers, by lightweight or heavier person and by beginners, future beginners, weekend skiers or highly experienced amateur or professional skiers. Moreover, the apparatus can be used by persons who do not intend or do not anticipate to ski but simply wish to build certain muscles and/or to carry out certain exercises in order to lose weight, to maintain a desired weight or to maintain their bodies in good physical shape. Still further, the apparatus can be used by skiers who wish to strengthen their bodies and perform a variety of movements preparatory to skiing on flat or inclined terrain, by ski jumpers, by persons preparing for alpine events or cross country skiing, by cyclists, by football players and/or other sportsmen. Other important advantages of the improved apparatus are relatively low cost, long useful life, safety, low inertia, ability to move each of the platforms and/or the swaying frame and/or the seesaw frame automatically to the neutral position and adjustability of all or nearly all mobile components.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. An exercising apparatus, particularly for use by downhill skiers, comprising a stationary main frame; first and second shafts in said main frame; a swaying frame having a first and a second pair of aligned front and rear links each including a lower end portion mounted for pivotal movement about the axis of the respective shaft and an upper end portion, and carrier means pivotally secured to the upper end portions of said links for angular movement about parallel substantially horizontal axes; resilient means for biasing said swaying frame to a neutral position in which said links are disposed at the opposite sides of a first central vertical longitudinal symmetry plane extending between the lower end portions of said pairs of links, said links being pivotable with reference to said main frame to either side of said plane against the opposition of said resilient means and said swaying frame having a second central longitudinal vertical symmetry plane which coincides with said first plane in the neutral position of said swaying frame; and first and second boot supporting platforms mounted on said carrier means at the opposite sides of said second plane, said platforms having third central longitudinal symmetry planes and the distance between said second plane and each of said third planes exceeding the distance between said second plane and each of said horizontal axes.

2. The apparatus of claim 1, wherein said pairs of links are mirror symmetrical to each other with reference to said first plane in the neutral position of said swaying frame and the length of each of said front links matches the length of the respective rear link, the links of said first pair being at least substantially parallel to the links of said second pair.

3. The apparatus of claim 1, wherein said carrier means comprises a seesaw frame having first and second portions which are mirror symmetrical to each other with reference to said second plane, said seesaw frame being rockable with referece to said swaying frame about at least one second substantially horizontal axis disposed in said second plane so that one of its portions moves upwardly while its other portion moves downwardly and vice versa, said platforms being mounted on the respective portions of said seesaw frame.

4. The apparatus of claim 3, further comprising means for limiting the rocking movements of said portions of said seesaw frame with reference to said swaying frame.

5. The apparatus of claim 3, further comprising means for biasing said seesaw frame to a neutral position in which said platforms are disposed at least substantially at the same level.

6. The apparatus of claim 3, wherein said seesaw frame comprises an upper and a lower section and means for compelling said sections to perform pivotal movements about two discrete second axes which are located in said second plane.

7. The apparatus of claim 6, wherein said compelling means comprises distancing elements arranged to maintain said sections in two discrete parallel planes each including one of said second axes, each of said portions of said seesaw frame including one-half of the upper and one-half of the lower section of said seesaw frame.

8. The apparatus of claim 7, wherein each of said sections includes a pair of longitudinally extending coupling members and further comprising means for varying the distance between such coupling members.

9. The apparatus of claim 3, wherein each of said portions includes at least one longitudinally extending coupling member and said platforms are mounted on the respective coupling members, said platforms being movable lengthwise of the respective coupling members and further comprising resilient means for yieldably urging said platforms to predetermined neutral positions as considered in the longitudinal direction of the respective coupling members.

10. The apparatus of claim 3, further comprising pivot means defining for each of said platforms a substantially vertical pivot axis about which the respective platform is movable relative to the corresponding portion of said seesaw frame.

11. The apparatus of claim 10, further comprising pairs of springs arranged to yieldably oppose pivotal movements of said platforms from predetermined neutral positions with reference to the corresponding portions of said seesaw frame.

12. The apparatus of claim 11, wherein the springs of each of said pairs of springs are arranged to act substantially tangentially of the respective pivot means and in opposite directions so that one spring of each pair stores energy when the other spring of the same pair dissipates energy and vice versa.

13. The apparatus of claim 1, further comprising means for adjusting the bias of said resilient means.

14. The apparatus of claim 13, wherein said main frame comprises a transversely extending bridge at one end of said swaying frame and said adjusting means is mounted on said bridge.

15. The apparatus of claim 14, wherein said adjusting means comprises a holder connected with said resilient means, a nut in said bridge, a substantially vertical feed screw meshing with said nut and connected with said holder, and means for rotating said feed screw with reference to said nut to thereby move said holder up or down.

16. The apparatus of claim 15, wherein said means for rotating said feed screw comprises a crank including a seat for the user of the apparatus.

17. The apparatus of claim 1, wherein said platforms are turnable with reference to said carrier means about longitudinally extending axes which are parallel to said horizontal axes and further comprising means for yieldably biasing said platforms to predetermined neutral positions with reference to the respective longitudinally extending axes.

18. The apparatus of claim 1, wherein each of said platforms is tiltable within limits relative to said swaying frame about a longitudinal axis extending in parallelism with said horizontal axes, wherein each of said platforms is turnable within limits with reference to said carrier means about a substantially vertical axis, and wherein each of said platforms is shiftable within limits relative to said carrier means lengthwise in parallelism with said horizontal axes.

19. The apparatus of claim 18, wherein each of said platforms is movable within limits up and down with reference to said swaying frame.

20. The apparatus of claim 19, further comprising resilient means arranged to yieldably oppose at least one of said tilting, turning, shifting and up-and-down movements of said platforms.

* * * * *